US007054231B2

(12) United States Patent
Valerio

(10) Patent No.: US 7,054,231 B2
(45) Date of Patent: May 30, 2006

(54) C-SHAPED MEDICATION REMINDER DEVICE

(76) Inventor: Juan Ruben Valerio, 25912 Haywood Blvd., Apt. 314, Haywood, CA (US) 94542

( * ) Notice: Subject to any disclaimer, the term of this patent is extended or adjusted under 35 U.S.C. 154(b) by 41 days.

(21) Appl. No.: 10/725,707

(22) Filed: Dec. 2, 2003

(65) Prior Publication Data

US 2005/0117455 A1 Jun. 2, 2005

(51) Int. Cl.
*G04B 47/00* (2006.01)

(52) U.S. Cl. ..... 368/10; 368/278

(58) Field of Classification Search ..... 368/10, 368/276, 277, 278, 327; 221/15, 2; 206/459.1, 206/230, 534; 968/229
See application file for complete search history.

(56) References Cited

U.S. PATENT DOCUMENTS

| | | | | |
|---|---|---|---|---|
| 3,996,879 | A | 12/1976 | Walton | |
| 4,223,801 | A * | 9/1980 | Carlson | 221/3 |
| 4,361,408 | A | 11/1982 | Wirtschafter | |
| 4,448,541 | A | 5/1984 | Wirtschafter | |
| 4,504,153 | A | 3/1985 | Schollmeyer | |
| 4,951,596 | A * | 8/1990 | Wallace, Jr. | 116/321 |
| 5,016,230 | A | 5/1991 | Seifers | |
| 5,099,463 | A * | 3/1992 | Lloyd et al. | 368/10 |
| 5,170,380 | A * | 12/1992 | Howard et al. | 368/10 |
| 5,233,571 | A | 8/1993 | Wirtschafter | |
| 5,313,439 | A | 5/1994 | Albeck | |
| 5,495,961 | A | 3/1996 | Maestre | |
| 5,583,831 | A * | 12/1996 | Churchill et al. | 368/10 |
| 5,724,021 | A | 3/1998 | Perrone | |
| 5,751,661 | A | 5/1998 | Walters | |
| 6,084,504 | A | 7/2000 | Rosche | |
| 6,158,613 | A | 12/2000 | Novosel | |
| 6,229,431 | B1 | 5/2001 | Weiner | |
| 6,294,999 | B1 * | 9/2001 | Yarin et al. | 340/573.1 |
| 6,317,390 | B1 | 11/2001 | Cardoza | |
| 6,335,907 | B1 | 1/2002 | Momich | |
| 6,424,599 | B1 | 7/2002 | Ditzig | |
| 6,430,111 | B1 * | 8/2002 | Shino | 368/204 |
| 6,441,722 | B1 | 8/2002 | Weiner | |
| 2001/0040500 | A1 | 11/2001 | Weiner | |
| 2002/0126585 | A1 | 9/2002 | Osberg | |

* cited by examiner

*Primary Examiner*—Andrew H. Hirshfeld
*Assistant Examiner*—Leo T. Hinze
(74) *Attorney, Agent, or Firm*—G. Turner Moller

(57) ABSTRACT

A medication reminder device provides a C-shaped support for receiving gently tapered pill bottles of a variety of sizes. The support is made in sections to provide an internal cavity receiving a timer. The timer includes, in circuit, a receptacle for a battery, an alarm, a timer assembly for periodically energizing the alarm and an on/off switch. The on/off switch includes an operator exposed through the interior of the support so that inserting a bottle into the support causes the operator to be depressed thereby initiating operation of the timer assembly.

11 Claims, 2 Drawing Sheets

C-SHAPED MEDICATION REMINDER DEVICE

BACKGROUND OF THE INVENTION

It is well known in the art to provide devices to remind a person to take medication. Many of these devices are incorporated in or associated with medication bottles, specifically pill bottles. Some of these devices are incorporated into the caps of pill bottles. One complication of reminder devices in bottle caps is that many different size caps must be made to accommodate the different sized bottles thereby aggravating inventory problems, i.e. many expensive bottle caps have to be kept in stock to handle the demand. A partial solution to the replacement of bottle caps is to reuse a reminder cap, i.e. take a reminder cap off an empty medication bottle and use it on a new bottle. One complication is that, occasionally, the cap from the old bottle will not fit the new one. There is also a problem in starting, or restarting, the timer mechanism in the bottle cap to fit or adjust the schedule of the medication in the new bottle.

Other reminder devices are housed in a receptacle into which the medication bottle is placed. The problems of correctly sizing the receptacle to receive the medication bottle is essentially the same.

Disclosures of interest are found in U.S. Pat. Nos. 3,996,879; 4,361,408; 4,448,541; 4,504,153; 5,016,230; 5,170,380; 5,233,571; 5,313,439; 5,495,961; 5,724,021; 5,751,661; 6,084,504; 6,158,613; 6,229,431; 6,317,390; 6,335,907; 6,424,599; 6,441,722 and U.S. Patent publications 2001/0040500 and 2002/0126585.

SUMMARY OF THE INVENTION

In this invention, a bottle alarm comprises a slightly resilient C-shaped structure that slips over the bottom of a conventional medication bottle. Conventional medication or pill bottles are generally cylindrical but are tapered slightly from a smaller bottom end to a larger open mouth. Although there may be many reasons for the taper, medication bottles are not apt to change because the taper is a solution to a production problem. Medication bottles are plastic and are made by injection molding. In order to extract the mold part that provides the interior of the bottle, the mold part is made slightly smaller at the bottom than at the top. Thus, any device that relies on, or takes advantage of the taper of medication bottles is not apt to go out of style because injection molded bottles will likely continue to be slightly tapered.

The C-shaped support includes a pair of curved arms having ends spaced apart by a gap. The arms are slightly resilient to clamp onto the medication bottle and to accommodate bottles of slightly different size thereby making the support usable on different sized bottles and reducing the inventory problem. Even though the taper of the bottle is fairly small, most bottles are of a sufficient height so the support can clamp onto one size bottom near its bottom and clamp onto the next larger size bottle nearer its top.

The C-shaped support carries a timer or clock including a battery receptacle, an alarm, a circuit for connecting the battery to the alarm and an on/off switch. The on/off switch is normally off and includes an operator exposed on the interior of the C-shaped support so, in response to the support being slipped onto the pill bottle, the switch is automatically turned on to close the circuit thereby initiating operation of the timer or clock. The C-shaped support includes a cavity in which the timer is located.

The circuit may be of any suitable type and is preferably either programmable or several versions of the circuit are made available so the alarm will be sounded at preselected intervals corresponding to the medication requirements of the user.

It is an object of this invention to provide an improved reminder device used in conjunction with a medication bottle.

A further object of this invention is to provide an improved alarm that fits easily on conventional medication bottles to remind the user to take the medication.

A more specific object of this invention is to provide a C-shaped support that slips over the bottom of a conventional pill bottle that contains circuitry to provide a periodic alarm to remind the user to take pills in the bottle.

These and other objects and advantages of this invention will become more apparent as this description proceeds, reference being made to the accompanying drawings and appended claims.

DETAILED DESCRIPTION

Figure 1:
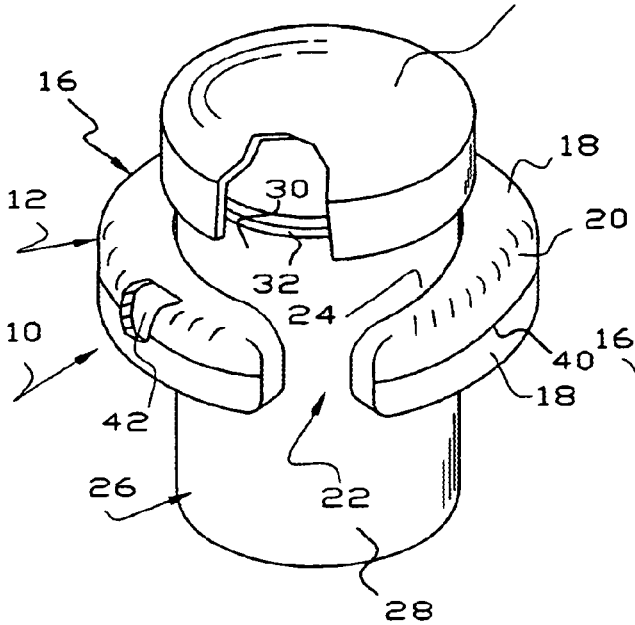
FIG. 1 is an isometric view of the medication reminder of this invention disposed on a conventional medication bottle.
Figure 4:
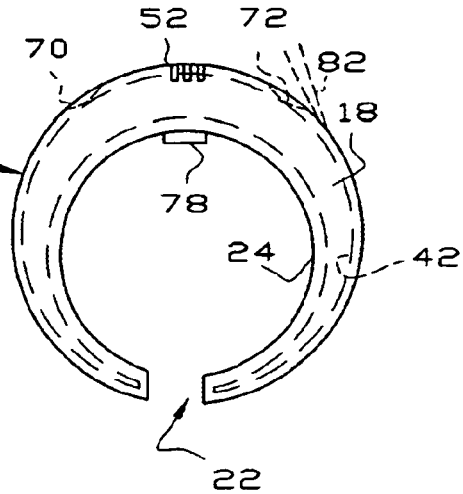
FIG. 4 is a top view of the device of FIGS. 2 and 3.

Referring to FIGS. 1–6, a medication reminder 10 of this invention comprises a support 12 and a timer circuit 14 carried by the support 12. The support 12 comprises a C-shaped body 16 having a pair of arms 18 having ends 20 separated by a gap 22. The size of an opening 24 provided by the body 16 is sufficient to pass over the small end of a medication bottle 26 but too small to pass over the top of the bottle 26. The medication bottle 26 appears to be cylindrical but is slightly tapered from a smaller circular bottom 28 to a larger open top 30 having a lip 32 closed by a lid 34, all in a conventional manner. The arms 18 are slightly resilient so the arms 18 are stressed as the bottle 26 passes through the support 12. Thus, the arms 18 captivate or clamp onto an intermediate portion of the bottle 26.

It will be seen that a support 12 of one size can accommodate bottles of somewhat different size because of the taper and height of the bottle and the resilience of the arms 18. In other words, by a judicious selection of the size of the opening 24 and the resilience of the arms 18, several size bottles can be accommodated by a support 12 of a given size. Thus, supports 12 in a few sizes can be designed to accommodate bottles of most conventional sizes.

The body 16 is preferably made of a organic polymeric material and may be injection molded or otherwise manufactured in a conventional manner. Typically, the body 16 is made in two halves 36, 38 and joined along a seam 40 thereby providing a cavity 42 for receiving the timer 14 to provide a periodic alarm for alerting the user that it is time to take medicine or pills from the bottle 26.

Figure 6:
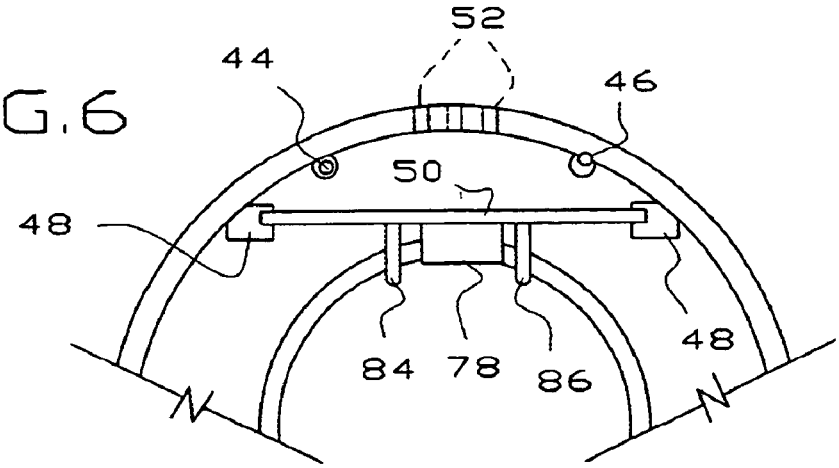
FIG. 6 is a view of the C-shaped support, one half being removed to expose the interior, showing a locating mechanism for a circuit board.

As shown best in FIG. 6, the halves 36, 38 include locating sockets 44 and pins 46 to align the halves 36, 38 together in a conventional manner. The halves 36, 38 may be secured together in any suitable manner, if desired, as with adhesives or by making the sockets 44 and pins 46 so the pins 46 may be inserted into the sockets 44 but not withdrawn. The halves 36, 38 also provide locating brackets 48 to receive a circuit board 50 providing the electronic components needed to provide the desired reminders, all as will be more fully apparent hereinafter. The body 16 also provides suitable openings 52 so sound from an audible alarm may efficiently exit the body 16.

The timer 14 includes, in circuit, a receptacle 54 for receiving a battery 56, a chip or assembly 58 mounted on the circuit board 50 and providing a timer function, one or more alarms 60, 62 and an on/off switch 64 which is normally off. The chip or assembly 58 may be of any suitable type, and preferably includes one or more adjusting mechanisms or buttons 66, 68 exposed through dimples or recesses 70, 72 on the exterior of the body 16. By pressing the button 66, the time delay provided by the assembly 58 is increased and by pressing the button 68, the time delay provided by the assembly 58 is decreased.

The alarms 60, 62 may be of any suitable type and conveniently include a visual alarm or light provided by a light emitting diode 74 and an audible alarm provided by a horn or other noise maker 76. The on/off switch 64 is normally open or off and includes an operator or actuator button 78 exposed on the interior of the C-shaped support 12. When the bottle 26 is slipped over the bottom 28 of the bottle 26 and passes into the opening 24 of the support 12, the bottle 26 contacts the actuator 78 thereby closing the circuit of the timer 14 and initiating operation of the timer assembly 58. After energizing one or more of the alarms 60, 62 for a predetermined time or the timer circuit is reset, as by slipping the support 12 off the bottle 26, the circuit 14 turns the alarms off until the next time medication is to be taken.

In the event the body 16 is made of an opaque material, a suitable opening (not shown) is provided for the light emitting diode 74 so the light emitted therefrom is visible from the exterior of the C-shaped support 12. Preferably, however, at least one of the body halves 36, 38 is transparent or translucent, together which mean the support 12 is non-opaque, and the light emitting diode 74 is inside the support 12. In this manner, energization of the LED 74 produces a large light source which is the support 12. It will be appreciated that a second light emitting diode 80 may be provided, of different color, so the support 12 may be illuminated internally in a pulsating style from one color to another. This tends to produce a much more effective alarm.

The battery 56 may be replaced by providing suitable access to the cavity 42 by the provision of a flap or other removable member 82 on the exterior of the C-shaped support 12. The time between energizing the alarms 60, 62 may be adjusted by manipulation of the circuitry inside the assembly 58 by depressing the buttons 66, 68.

Figure 2:
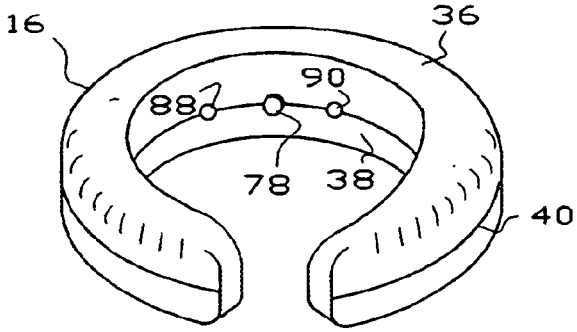
FIG. 2 is an isometric view of the reminder of FIG. 1 absent the bottle.
Figure 5:
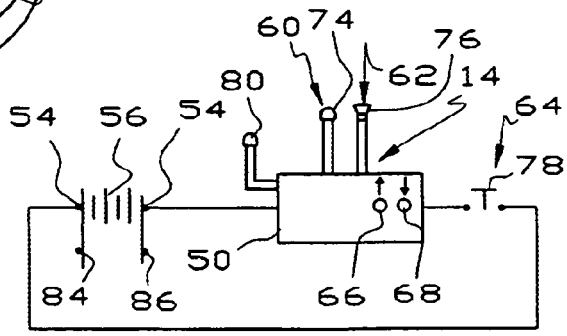
FIG. 5 is a schematic diagram of the circuitry used in the operation of the medication reminder of this invention.

An interesting feature of this invention is the ability to provide a rechargeable battery and recharge it with a specially shaped battery charger (not shown) having terminals (not shown) to contact terminals 84, 86 extending through small openings 88, 90 (FIG. 2). When it is desired to recharge the battery 56, the medication reminder 10 is removed from the bottle 26 and inserted on the battery charger (not shown) which has a slot or other arrangement to avoid depressing the actuator button 78 but allow the terminals 84, 86 to make electrical contact with the charger.

Figure 7:
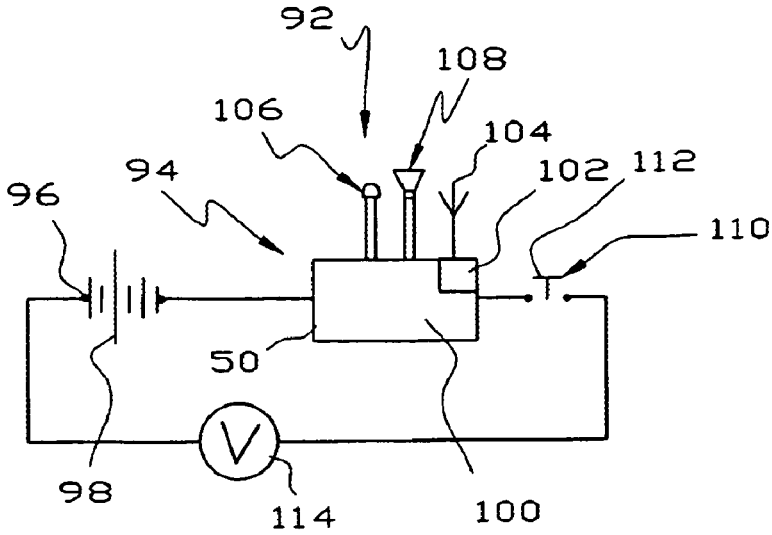
FIG. 7 is a schematic diagram of circuitry used in the operation of another medication reminder of this invention.
Figure 3:
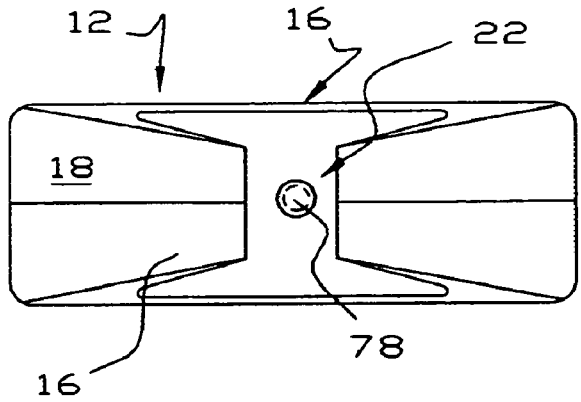
FIG. 3 is a view of the device of FIG. 2 looking through the gap in the C-shaped support.

Referring to FIG. 7, another medication reminder 92 based on a slightly different principle of operation. The reminder 92 includes a circuit 94 having, in circuit, a receptacle 96 for receiving a battery 98, a chip or assembly 100 mounted on a circuit board and providing a receiver 102 including an antenna 104, one or more alarms 106, 108 and an on/off switch 110 which is normally off. The circuit board is located inside a support 12 and the switch 110 provides an actuator button 112 exposed through the inside, analogous to the actuator button 78. The chip or assembly 100 acts to receive a signal from remote site and, in response thereto, energize one or more of the alarms 106, 108. The concept is that the medication user contracts with a vendor who sends a signal at appropriate times which is received by the antenna 102. The signal may be of any suitable type, such as a conventional radio frequency signal or a pager signal where the receiver 102 is a pager receiver. In this manner, signals may be sent and received at any desired interval.

The medication reminder 92 also includes a vibrator motor 114 in circuit with the assembly 100 to provide a tactile alarm It will accordingly be seen that there is provided an improved medication reminder device which is usable on tapered generally cylindrical medication bottles of different sizes providing an alarm for notifying the user that it is time to take medication.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A medication reminder for a bottle tapered from a small generally circular bottom end to a large generally circular open mouth, the device comprising a C-shaped support including a pair of arms having spaced apart ends and comprising a pair of hollow C-shaped halves joined together to provide a cavity between the C-shaped halves, the support being sized to receive the small bottom end of the bottle and resilient to expand and thereby captivate an intermediate section of the bottle; and a circuit in the cavity including a battery receiver, an alarm, circuitry connecting the battery receiver and the alarm for energizing the alarm at predetermined times and a normally off switch exposed through an interior of the C-shaped support for closing the circuitry and starting the timer in response to placing a bottle into the interior of the support.

2. The medication reminder device of claim 1 herein the circuit provides a timer and the circuitry includes an adjusting device for adjusting the duration between energizing of the alarm, the adjusting device being exposed through an exterior of the C-shaped support.

3. The medication reminder device of claim 1 wherein the circuit provides a receiver including an antenna for receiving a signal from a remote source for energizing the alarm at predetermined times.

4. The medication reminder device of claim 1 wherein the C-shaped support is non-opaque and the alarm is a light emitter having an output device inside the support so energization of the light emitter produces light inside the non-opaque support which is visible from exterior of the support.

5. The medication reminder device of claim 4 wherein the alarm includes a second light emitter providing a different color from the first mentioned light emitter.

6. The medication reminder device of claim 5 wherein the circuitry provides for alternately energizing the first light emitter and the second light emitter.

7. The medication reminder device of claim 1 wherein the battery terminals include terminals exposed through the support for engagement with a battery charger for recharging a battery in the battery receiver.

8. The medication reminder device of claim 1 wherein the C-shaped halves provide, inside the cavity, registration devices aligning the C-shaped halves with each other.

9. The medication reminder device of claim 8 wherein the circuitry is mounted on a circuit board having a switch button thereon, the C-shaped support providing an opening through which the switch button extends.

10. The medication reminder device of claim 9 wherein the C-shaped halves provide, inside the cavity, at least one location device positioning the circuit board in a position where the switch button extends through the opening.

11. A medication reminder for a bottle tapered from a small generally circular bottom end to a large generally circular open mouth, the device comprising a C-shaped support including a pair of arms having spaced apart ends and comprising a plurality of hollow C-shaped members joined together to provide a cavity between the C-shaped members, the support being sized to receive the small bottom end of the bottle and resilient to expand and thereby captivate an intermediate section of the bottle; and a circuit in the cavity including a battery receiver, an alarm, circuitry connecting the battery receiver and the alarm for energizing the alarm at predetermined times and a normally off switch exposed through an interior of the C-shaped support for closing the circuitry and starting the timer in response to placing a bottle into the interior of the support.

* * * * *